US010264853B2

(12) United States Patent
Arayama et al.

(10) Patent No.: US 10,264,853 B2
(45) Date of Patent: Apr. 23, 2019

(54) INSOLE DESIGN AND FABRICATE SYSTEM

(71) Applicant: DREAM GP INC., Osaka-shi, Osaka (JP)

(72) Inventors: Motohide Arayama, Osaka (JP); Shinkichi Oshiki, Osaka (JP)

(73) Assignee: DREAM GP INC., Osaka-Shi, Osaka (JP)

( * ) Notice: Subject to any disclaimer, the term of this patent is extended or adjusted under 35 U.S.C. 154(b) by 895 days.

(21) Appl. No.: 14/378,239

(22) PCT Filed: Sep. 6, 2013

(86) PCT No.: PCT/JP2013/074092

§ 371 (c)(1),
(2) Date: Aug. 12, 2014

(87) PCT Pub. No.: WO2014/042094

PCT Pub. Date: Mar. 20, 2014

(65) Prior Publication Data

US 2015/0006119 A1 Jan. 1, 2015

(30) Foreign Application Priority Data

Sep. 11, 2012 (JP) ..... 2012-199557

(51) Int. Cl.
*A43D 1/02* (2006.01)
*A43B 7/14* (2006.01)
(Continued)

(52) U.S. Cl.
CPC ..... *A43D 1/02* (2013.01); *A43B 7/141* (2013.01); *A43B 7/142* (2013.01); *A43B 7/1445* (2013.01);
(Continued)

(58) Field of Classification Search
None
See application file for complete search history.

(56) References Cited

U.S. PATENT DOCUMENTS 7,089,152 B2 8/2006 Oda et al.
7,325,323 B2 2/2008 Katsu et al.
(Continued)

FOREIGN PATENT DOCUMENTS

JP H03-067104 U 6/1991
JP 3031739 U 12/1996
(Continued)

OTHER PUBLICATIONS

PCT, "International Search Report for International Application No. PCT/JP2013/074092".
(Continued)

*Primary Examiner* — Craig C Dorais
(74) *Attorney, Agent, or Firm* — Manabu Kanesaka

(57) ABSTRACT

Provided is an insole design system that can determine design parameters in accordance with set rules and can explain the design parameters in an easy-to-understand manner.

The present invention is provided with: a foot dimensions input unit (52) that receives input of the dimensions of the outer shape of a foot; a design parameter input unit (54) that, with respect to the shape of a specific portion of the surface of an insole, receives the input of design parameters determined with the position of a foot bone as a baseline; a bone position estimation unit (56) that, from the dimensions received by the foot dimensions input unit (52), estimates the position of the bone that is the baseline of the design parameters; and a data calculation unit (58) that calculates data for fabricating the shape of the surface of the insole from the design parameters received by the design parameter
(Continued)

input unit (54) and the position of the bone estimated by the bone position estimation unit (56).

4 Claims, 13 Drawing Sheets

(51) Int. Cl.
*A43B 7/28* (2006.01)
*A43B 13/38* (2006.01)
*G06F 17/50* (2006.01)

(52) U.S. Cl.
CPC ..... *A43B 7/28* (2013.01); *A43B 13/38* (2013.01); *G06F 17/50* (2013.01); *A43D 2200/60* (2013.01)

(56) References Cited

U.S. PATENT DOCUMENTS

| | | | | |
|---|---|---|---|---|
| 2002/0138923 | A1 | 10/2002 | Shaffeeullah | |
| 2005/0049816 | A1 | 3/2005 | Oda et al. | |
| 2006/0143839 | A1* | 7/2006 | Fromme | A43B 7/00 12/142 R |
| 2006/0201011 | A1 | 9/2006 | Katsu et al. | |
| 2009/0126225 | A1* | 5/2009 | Jarvis | A43B 13/41 36/29 |
| 2013/0031803 | A1* | 2/2013 | Koch | A43B 1/0072 36/100 |

FOREIGN PATENT DOCUMENTS

| | | | |
|---|---|---|---|
| JP | H11-187907 | A | 7/1999 |
| JP | 2001-000208 | A | 1/2001 |
| JP | 2002-159302 | A | 6/2002 |
| JP | 2002-177015 | A | 6/2002 |
| JP | 2004-000786 | A | 1/2004 |
| JP | 2004-181206 | A | 7/2004 |
| JP | 2004-275611 | A | 10/2004 |
| JP | 2004-305374 | A | 11/2004 |
| JP | 3137991 | U | 12/2007 |
| JP | 2009-045244 | A | 3/2009 |
| JP | 2010-115291 | A | 5/2010 |
| WO | 02/40941 | A1 | 5/2002 |
| WO | 2005/006905 | A1 | 1/2005 |

OTHER PUBLICATIONS

Japan Patent Office, "Office Action for Japanese Patent Application No. 2016-116679," May 18, 2017.

* cited by examiner

INSOLE DESIGN AND FABRICATE SYSTEM

RELATED APPLICATIONS

The present application is National Phase of International Application No. PCT/JP2013/074092 filed Sep. 6, 2013, and claims priority from Japanese Application No. 2012-199557, filed Sep. 11, 2012.

TECHNICAL FIELD

The present invention relates to an insole design system and, in particular, to an insole design system for designing and fabricating individually an insole to be placed in a shoe.

BACKGROUND ART

Various kinds of insoles have been proposed that have a shape and a structure corresponding to the arch structure of the skeleton of the foot. Further, a technique has been proposed that an insole having an optimal shape with respect to an individual difference or an application is fabricated with measuring the three-dimensional shape of the foot (for example, see Patent Document 1).

CITATION LIST

Patent Literature

Patent Document 1: Japanese Laid-Open Patent Publication No. 2009-45244

SUMMARY OF THE INVENTION

Problem to be Solved by the Invention

A custom-made insole is fabricated in a shape in which depressions and protrusions are added in appropriate portions in accordance with the shape of the foot obtained by molding or measurement. If the positions and the dimensions of the depressions and protrusions to be added in accordance with the shape of the foot were determined by experience or intuition of a designer, a different insole would be fabricated depending on the designer. This situation is not preferable.

For the purpose of obtaining a fixed quality, it is desired that design parameters can be determined in accordance with a fixed rule. Further, it is desired that the design parameters can be explained in an easy-to-understand manner to a person who places an order for the insole, like what kind of effect has been aimed in the design of the insole and how the effect is reflected in the design parameters. Further, it is desired that the fabrication history of the insole can easily be utilized, for example, in a case that an insole used in another shoe is to be fabricated on the basis of design data of an insole fabricated in the past or, alternatively, in a case that an insole is to be refabricated with observing a change in the shape of the foot or in the motion of the foot at the time of walking caused by the use of the insole.

The present invention has been devised in view of such situations. An object thereof is to provide an insole design system in which design parameters can be determined in accordance with a fixed rule, the design parameters can be explained in an easy-to-understand manner, and the fabrication history of the insole can easily be utilized.

Means for Solving the Problem

In order to resolve the above-mentioned problem, the present invention provides an insole design system having the following configuration.

An insole design system comprises: (a) a foot dimensions input unit for receiving input of dimensions of an outer shape of a foot; (b) a design parameter input unit for receiving input of design parameters concerning a shape of a specific portion of a surface of an insole and determined with reference to a position of a bone of the foot; (c) a bone position estimation unit for estimating the position of the bone serving as a reference of the design parameters, from the dimensions received by the foot dimensions input unit; and (d) a data calculation unit for, from the position of the bone estimated by the bone position estimation unit and the design parameters received by the design parameter input unit, calculating data used for forming the shape of the surface of the insole.

In the above-mentioned configuration, when the dimensions of the outer shape of the foot and the design parameters are inputted, the insole design system calculates data used for forming the surface shape of the insole.

According to the above-mentioned configuration, the design parameters are determined with reference to the position of the bone of the foot. Thus, the design parameters for the insole can be determined in accordance with a fixed rule in which the position of the bone of the foot is taken into consideration. Further, the design parameters can be explained in an easy-to-understand manner. Furthermore, as the fabrication history of the insole, design parameters defined with reference to the position of the bone of the foot are accumulated so that the fabrication history of the insole can easily be utilized.

Preferably, the specific portion includes an inner arch corresponding to an inner side longitudinal arch of the foot. The design parameters include a peak height, a peak position, and an arch length of the inner arch. The peak position of the inner arch is determined with reference to any one of a medial cuneiform bone, a navicular bone, and a sustentaculum tali of the calcaneus bone. In the arch length of the inner arch, one end of the inner arch is determined with reference to a position of the calcaneus bone and the other end of the inner arch is determined with reference to a position of the first metatarsal bone. The bone position estimation unit estimates the positions of the medial cuneiform bone, the navicular bone, the calcaneus bone and the sustentaculum tali thereof, and the first metatarsal bone, from the dimensions received by the foot dimensions input unit.

In this case, the inner arch corresponding to the inner side longitudinal arch of the foot can be designed easily and efficiently with reference to the bone whose position has been estimated from the dimensions of the outer shape of the foot.

Preferably, the specific portion includes an outer arch corresponding to an outer side longitudinal arch of the foot. The design parameters include a peak height, a peak position, and an arch length of the outer arch. The peak position of the outer arch is determined with reference to the position of the cuboid bone. In the arch length of the outer arch, one end of the outer arch is determined with reference to a position of the calcaneus bone and the other end of the outer arch is determined with reference to a position of the fifth metatarsal bone. The bone position estimation unit estimates the positions of the cuboid bone, the calcaneus bone, and the fifth metatarsal bone from the dimensions received by the foot dimensions input unit.

In this case, the outer arch corresponding to the outer side longitudinal arch of the foot can be designed easily and efficiently with reference to the bone whose position has been estimated from the dimensions of the outer shape of the foot.

Effects of the Invention

According to the present invention, design parameters can be determined in accordance with a fixed rule and the design parameters can be explained in an easy-to-understand manner.

MODE FOR CARRYING OUT THE INVENTION

Embodiments of the present invention are described below with reference to FIGS. 1 to 20.

Figure 1:
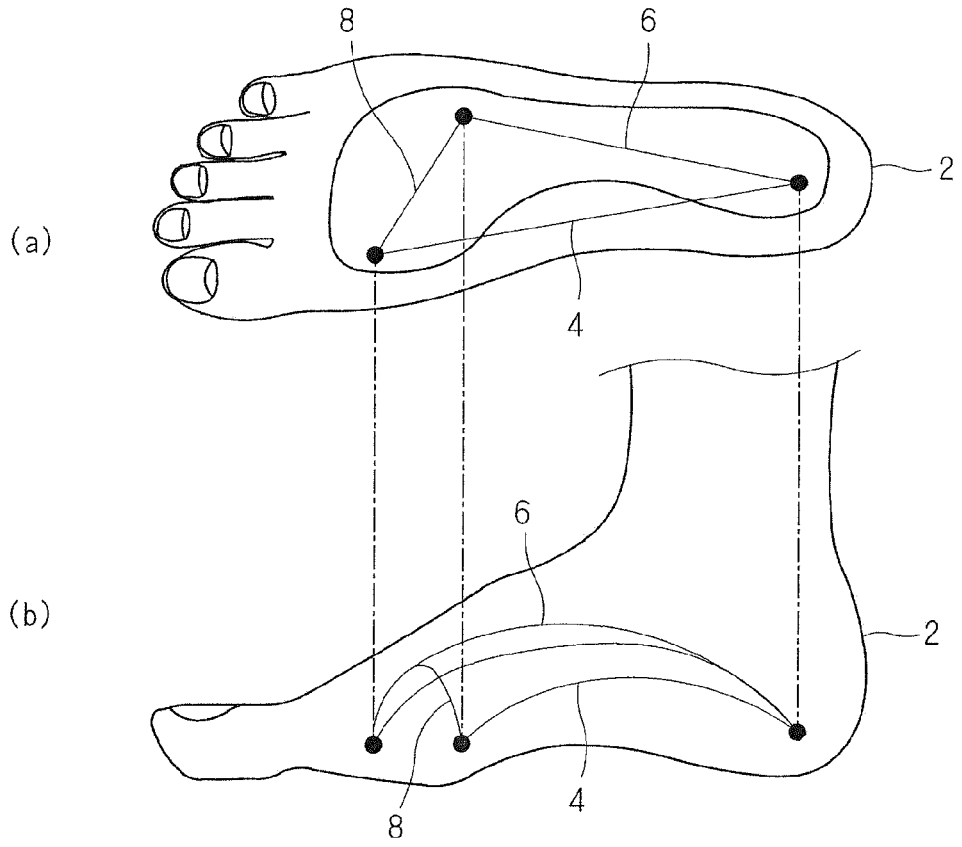
FIG. 1 is an explanation diagram for the arch structure of the skeleton of a foot.
Figure 2:
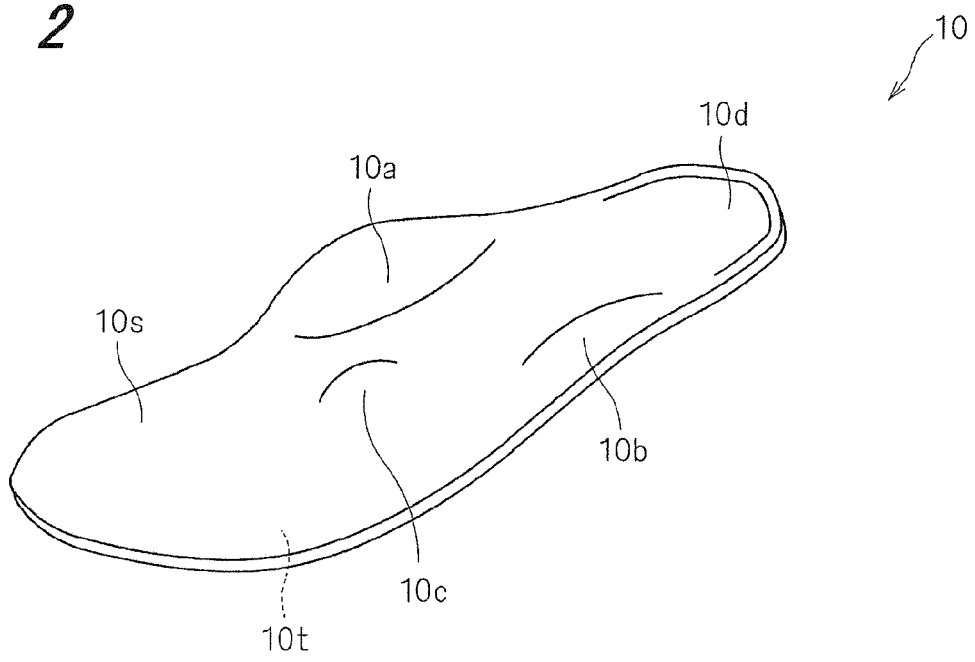
FIG. 2 is a schematic diagram of an insole.

FIG. 1 is an explanation diagram for the arch structure of the skeleton of a foot 2, showing a right foot. FIG. 2 is a schematic diagram showing the shape of the surface 10*s* of an insole 10, showing one for the left foot. As shown in FIG. 1, in the skeleton of the foot 2, lines 4, 6, and 8 joining the three points of the root of the big toe, the root of the little finger, and the heel are warped in arc shapes. These arches are referred to as an inner side longitudinal arch 4, an outer side longitudinal arch 6, and a transverse arch 8, respectively. In accordance with such an arch structure of the foot, as shown in FIG. 2, protruded portions 10*a*, 10*b*, and 10*c*, a depressed portion 10*d*, and the like are formed in the surface 10*s* of the insole 10 so that the body weight can be supported by the entire sole and the shape of the arch structure of the foot can be adjusted.

Figure 3:
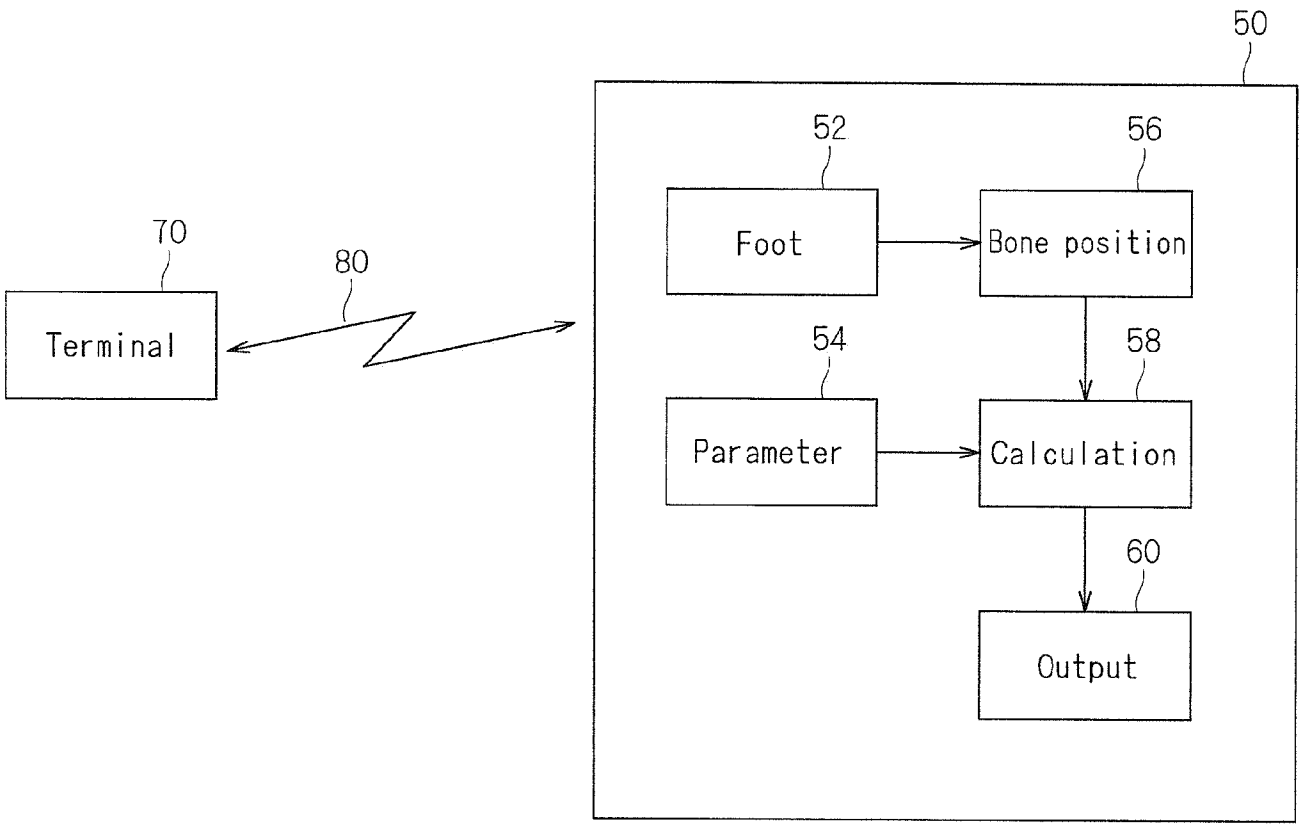
FIG. 3 is a block diagram showing a configuration of an insole design system.
Figure 4:
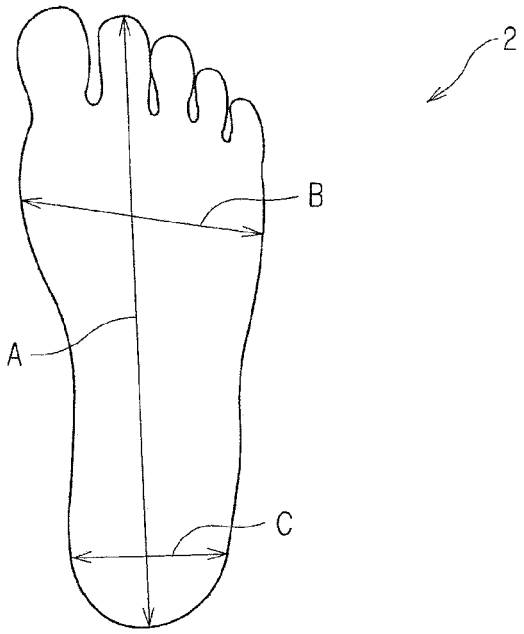
FIG. 4 is an explanation diagram for the dimensions of the outer shape of a foot.

FIG. 3 is a block diagram showing the configuration of an insole design system 50. As shown in FIG. 3, the insole design system 50 is constructed on a server and connected to a terminal 70 through a communication network 80 such as an LAN and the Internet so as to perform communication with the terminal 70. For example, the terminal 70 may be constructed from: a personal computer provided with a display, a keyboard, a touchpad, a mouse, and the like; a tablet type computer provided with a touch panel; a smart phone (a multifunctional portable phone or PHS); or the like.

Here, a part of the function of the insole design system 50 may be installed as application software in the terminal 70. Further, the insole design system 50 and the terminal 70 may be integrated with each other by direct connection or the like so as to constitute a dedicated device of stand-alone type.

As shown in FIG. 3, the insole design system 50 includes a foot dimensions input unit 52, a design parameter input unit 54, a bone position estimation unit 56, a data calculation unit 58, and an output unit 60.

Figure 15:
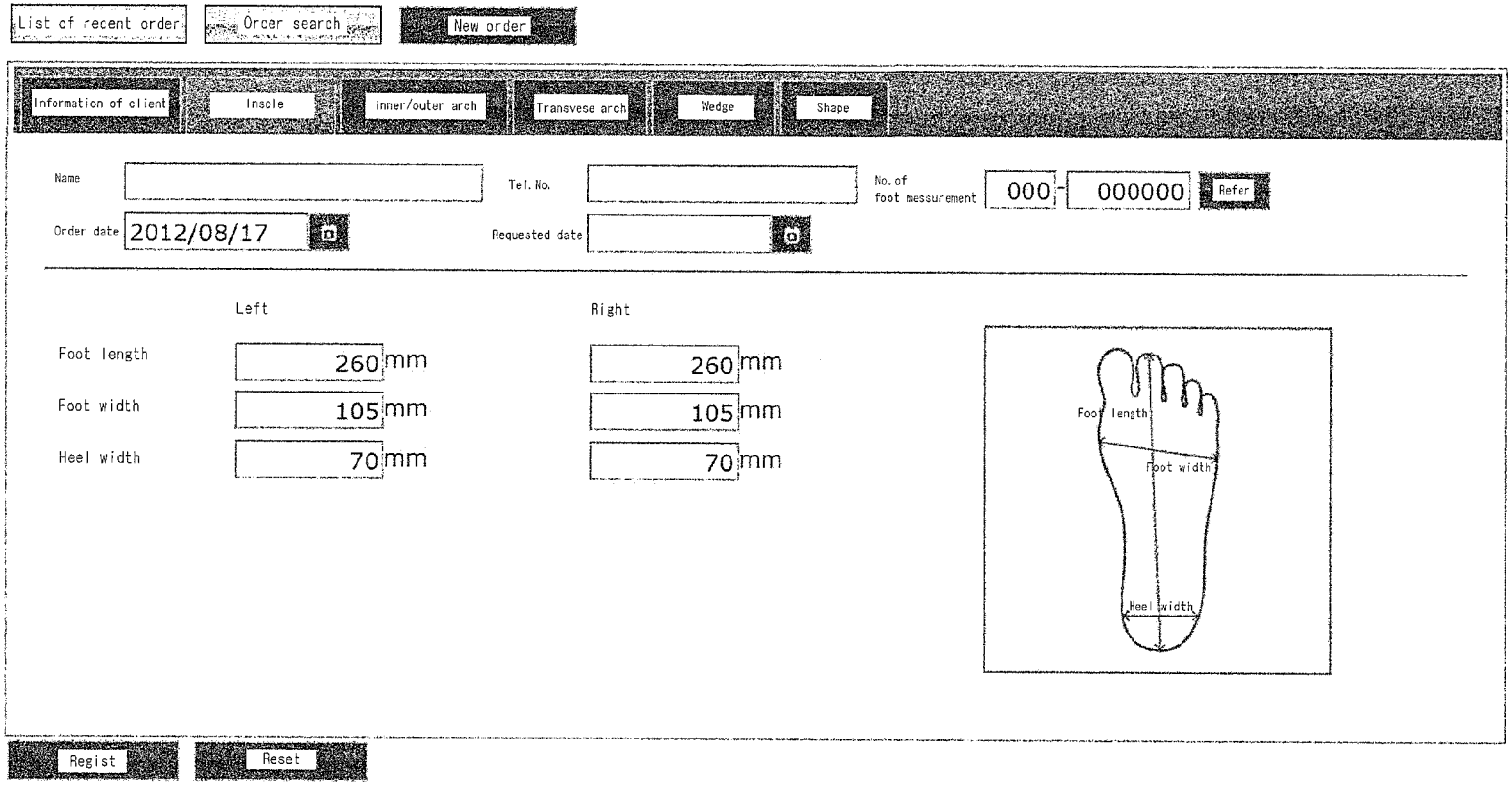
FIG. 15 is an explanation diagram for screen display on a terminal.

The foot dimensions input unit 52 transmits, to the terminal 70, data used for displaying a screen shown in FIG. 15 onto the terminal 70 and then, when the terminal 70 is operated, receives input concerning the dimensions of the outer shape of the foot. As shown in the explanation diagram of FIG. 4, the dimensions of the outer shape of the foot whose input is received by the foot dimensions input unit 52 include dimensions consisting of the foot length A, the foot width B, and the heel width C. The foot length A, the foot width B, and the heel width C may be defined appropriately. For example, the foot length A is the length of the foot outer shape on a line along the line joining the heel and the second toe in a situation that the reference in contact with the foot is viewed vertically. The foot width B is the length of the outer shape of the foot on the line joining the roots of the first toe and the fifth toe in a situation that the reference in contact with the foot is viewed vertically. The heel width C is the width of the outer shape of the foot at a position of 17% of the foot length from the heel (the dimension on a line perpendicular to the line joining the heel and the second toe) in a situation that the reference in contact with the foot is viewed vertically.

Figure 5:
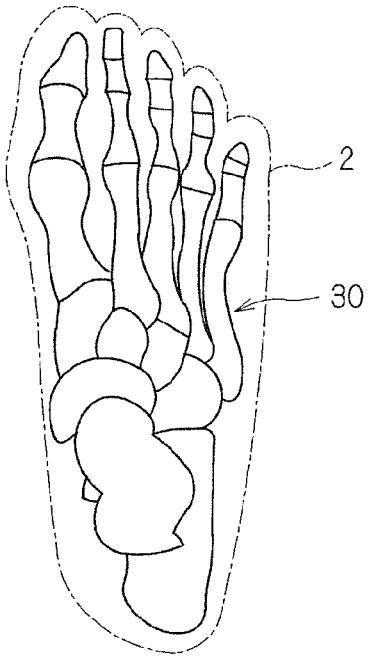
FIG. 5 is an explanation diagram for the bone of a foot.

From the dimension data of the outer shape of the foot whose input has been received by the foot dimensions input unit 52, the bone position estimation unit 56 estimates the position of a specific bone (described later in detail) contained in the skeleton 30 in the inside of the foot 2 as shown in FIG. 5.

The bone position estimation unit 56 estimates the position of the bone, for example, by using the data of a standard model in which the dimensions of the outer shape of a foot and the position of the bone are in advance made into correspondence to each other. Specifically, with respect to the foot length, the foot width, and the heel width, ratios are calculated between the data whose input has been received by the foot dimensions input unit 52 and the data of the standard model. Then, on the basis of the ratios, the standard model is expanded or reduced and then the position of the bone in the expanded or reduced standard model is adopted as the estimated position. A plurality of standard models may be prepared in advance and then several standard models may be selected such that the difference from the input data of the foot length, the foot width, and the heel width becomes small. Then, the position of the bone may be estimated by interpolation using the selected standard models. The employed standard model may be different depending on the type of the foot (such as a Greek type, an Egyptian type, and a square type).

Here, the position of the bone of the foot may be estimated by a method other than the above-mentioned one. However, the position of the bone of the foot serves as the reference at the time of designing the insole and hence need be estimated uniquely.

In response to the operation from the terminal 70, the design parameter input unit 54 transmits, to the terminal 70, data used for displaying a screen shown in FIGS. 16 to 20 and then, when the terminal 70 is operated, receives input concerning the design parameters. The design parameter input unit 54 receives input of the following design parameters (a) to (g), from the terminal 70.

(a) Insole Length, Insole Width, Insole Thickness, and Insole Shape

Figure 6:
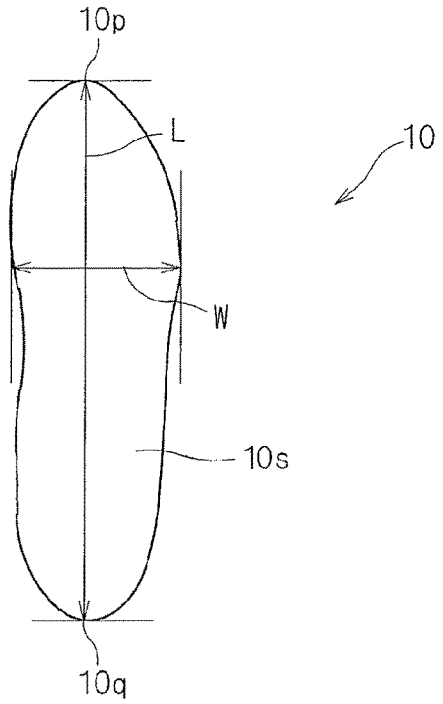
FIG. 6 is an explanation diagram for design parameters of an insole.
Figure 7:
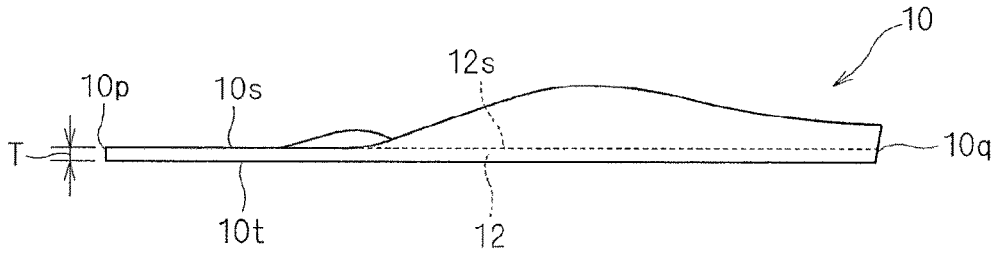
FIG. 7 is an explanation diagram for design parameters of an insole.
Figure 8:
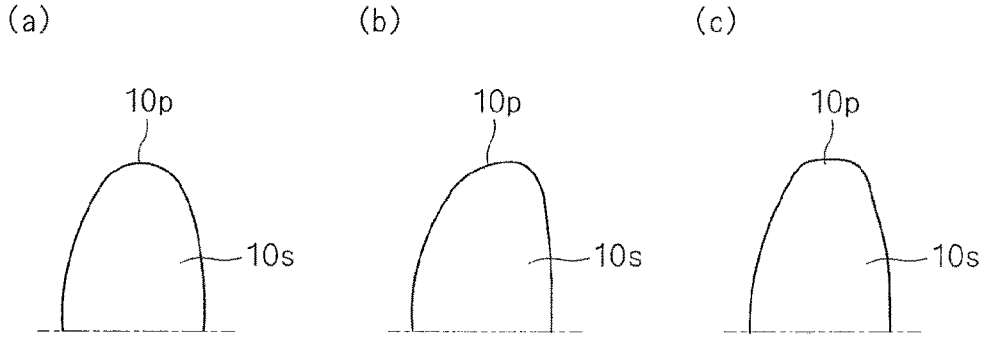
FIG. 8 is an explanation diagram for design parameters of an insole.
Figure 16:
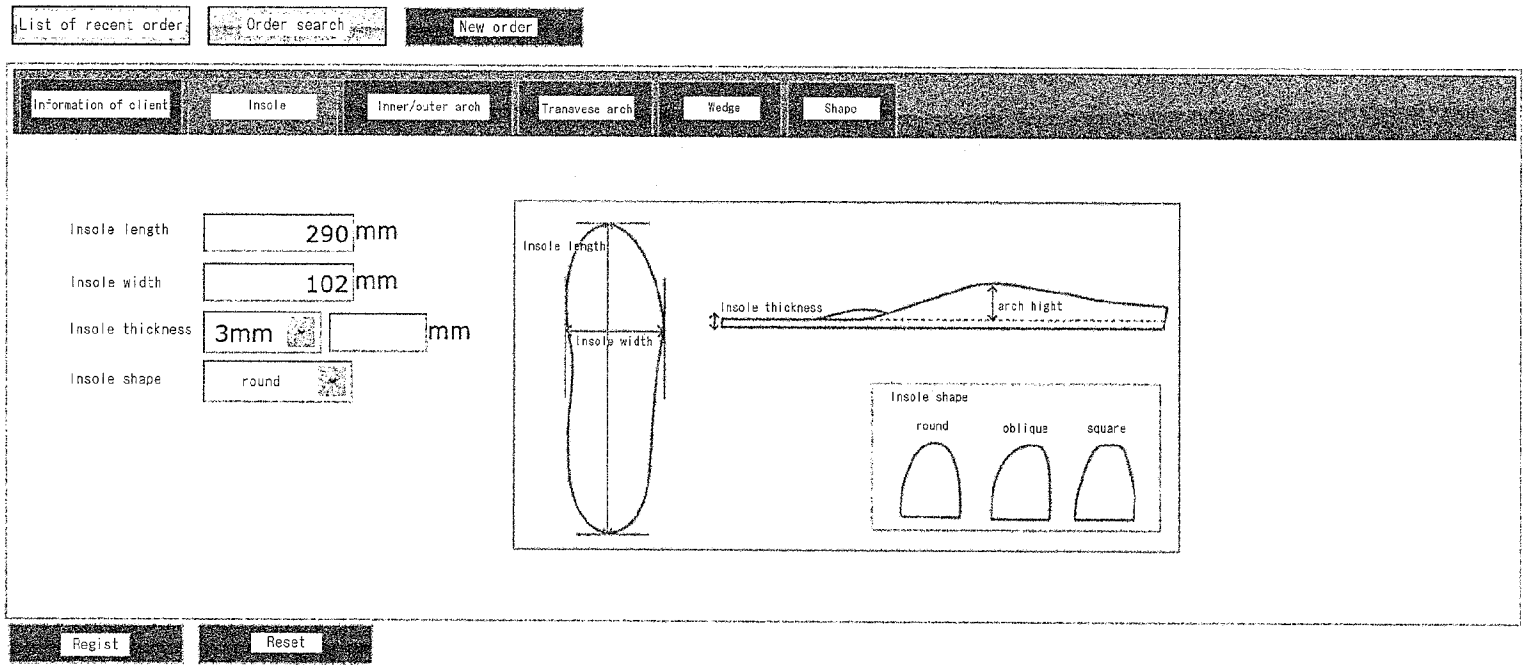
FIG. 16 is an explanation diagram for screen display on a terminal.

In a state that the screen shown in FIG. 16 is displayed on the terminal 70, when the terminal 70 is operated, basic data of the insole can be inputted. That is, the basic data that can be inputted are: the insole length L and the insole width W shown in the plan view of FIG. 6; the insole thickness T shown in the side view of FIG. 7 (the dimension between the bottom face 12*t* and the upper face 12*s* concerning the base part 12 having a fixed thickness); and the type of insole shape concerning the foot tip portion shown in the enlarged main part view of FIG. 7. FIG. 7(*a*) shows a round type, FIG. 7(*b*) shows an oblique type, and FIG. 7(*c*) shows a square type. In FIGS. 6 to 8, numeral 10*p* indicates a foot-tip-side end and numeral 10*q* indicates a heel-side end. The basic data of the insole is inputted in accordance with the dimensions and the shape of the inside of the shoe in which the insole is to be placed.

(b) Peak Height, Peak Position, and Arch Length of Inner Arch

Figure 17:
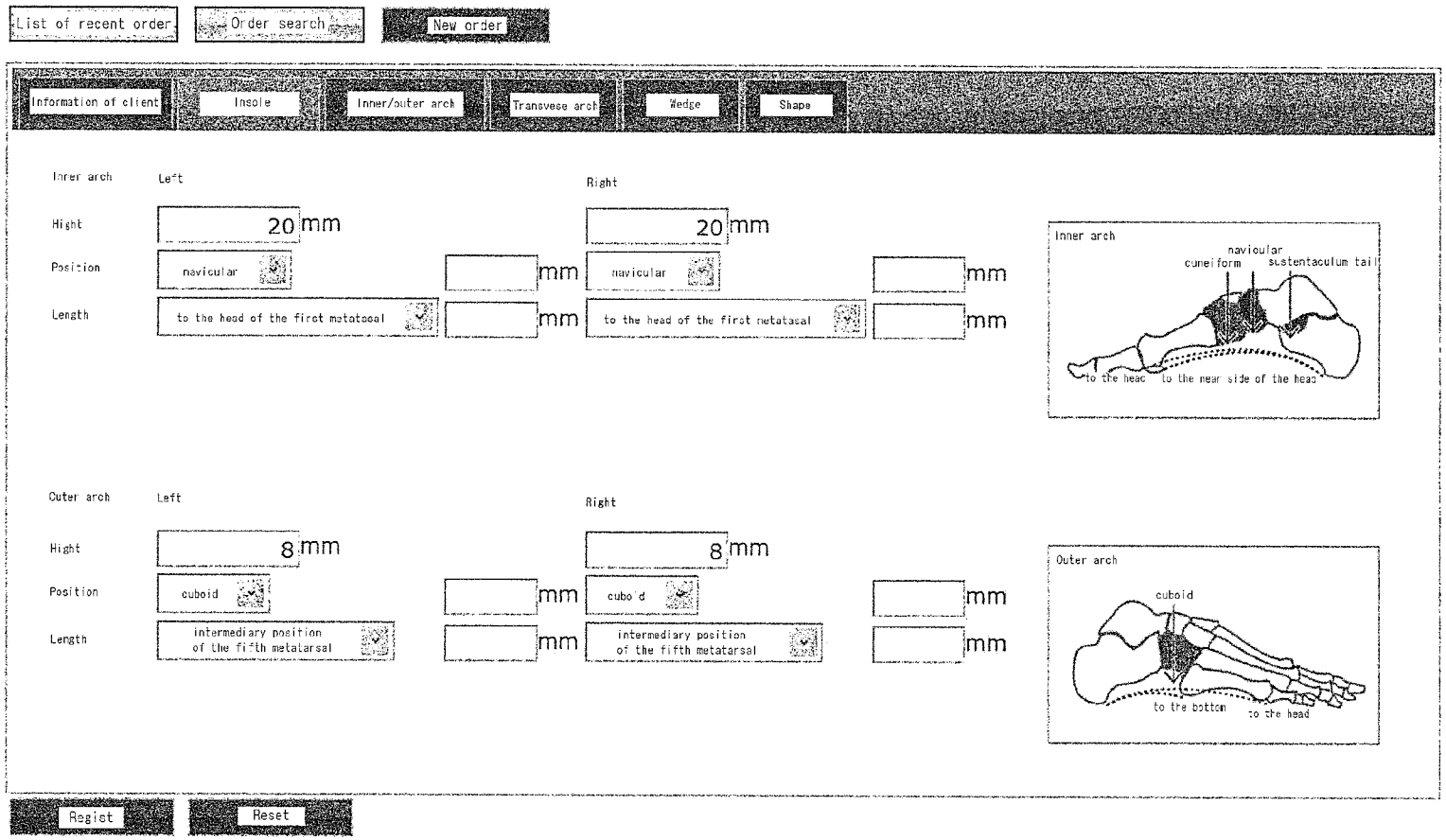
FIG. 17 is an explanation diagram for screen display on a terminal.

In a state that the screen shown in FIG. 17 is displayed on the terminal 70, when the terminal 70 is operated, design parameters (the peak height, the peak position, and the arch length) concerning the inner arch 10*a* (see FIG. 2) of the insole 10 can be inputted.

Figure 9:
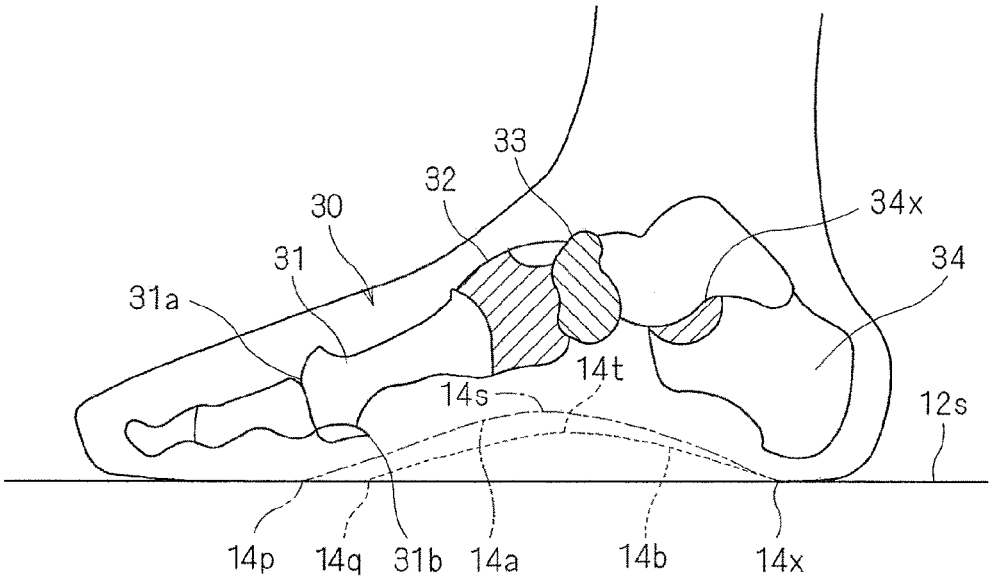
FIG. 9 is an explanation diagram for design parameters of an insole.

As shown in FIG. 9, the peak heights indicate the heights of the peaks 14*s* and 14*t* of the inner arches 14*a* and 14*b* and are vertical dimensions measured from a reference plane 12*s* (the upper face 12*s* of the base part 12). The peak positions are the positions of the peaks 14*s* and 14*t* of the inner arches 14*a* and 14*b*. Then, the position of any one of the medial cuneiform bone 32, the navicular bone 33, and the sustentaculum tali 34*x* of the calcaneus bone 34 is selected and then, when necessary, the dimension in the foot length direction from the selected position to the peak position is inputted. That is, the peaks 14*s* and 14*t* of the inner arches 14*a* and 14*b* are arranged immediately under the selected bone or alternatively at a position shifted therefrom in the foot length direction.

As the arch length, the positions of the foot-tip-side ends 14*p* and 14*q* of the inner arches 14*a* and 14*b* are inputted. That is, the position of the head 31*a* or the near side 31*b* of the head of the first metatarsal bone 31 is selected and then, when necessary, the dimensions in the foot length direction from the selected position to the foot-tip-side ends 14*p* and 14*q* are inputted. The heel-side end 14*x* of the inner arches 14*a* and 14*b* is determined with reference to the position of the calcaneus bone 34 and hence input of design parameters is unnecessary. Both ends 14*p*, 14*q*; 14*x* of the inner arches 14*a* and 14*b* are located on the reference plane 12*s* (the upper face 12*s* of the base part 12).

(c) Peak Height, Peak Position, and Arch Length of Outer Arch

In a state that the screen shown in FIG. 17 is displayed on the terminal 70, when the terminal 70 is operated, design parameters (the peak height, the peak position, and the arch length) concerning the outer arch 10*b* (see FIG. 2) of the insole 10 can be inputted.

Figure 10:
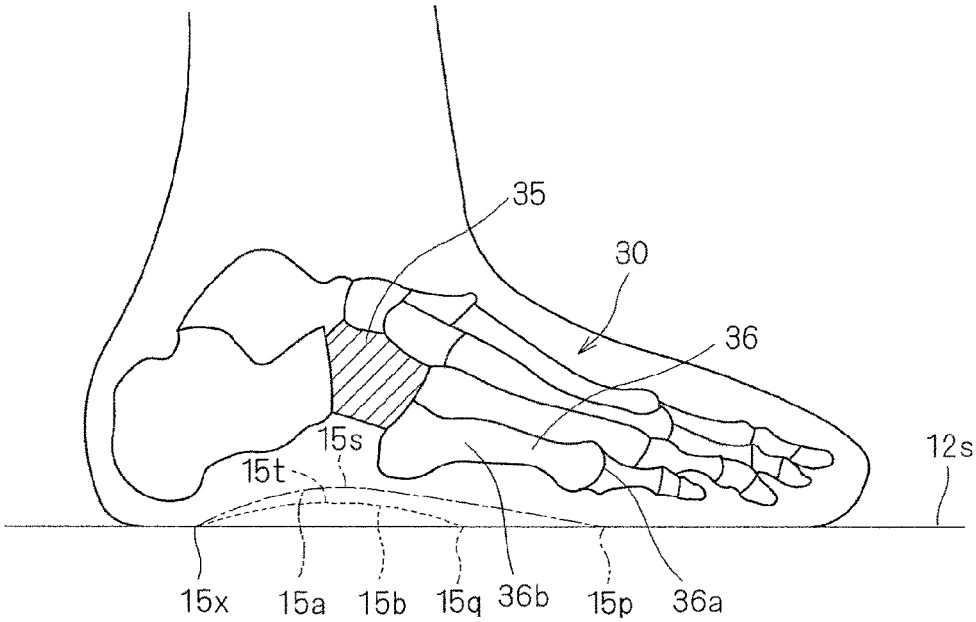
FIG. 10 is an explanation diagram for design parameters of an insole.

As shown in FIG. 10, the peak heights indicate the heights of the peaks 75*s* and 15*t* of the outer arches 15*a* and 15*b* and are vertical dimensions measured from a reference plane 12*s* (the upper face 12*s* of the base part 12). The peak positions are the positions of the peaks 15*s* and 15*t* of the outer arches 15*a* and 15*b* and, when necessary, with adopting as a reference a predetermined position (e.g., the center position) of the cuboid bone 35, the dimension in the foot length direction from the reference position to the peak position is inputted. That is, the peaks 15*s* and 15*t* of the outer arches 15*a* and 15*b* are arranged immediately under the predetermined position of the cuboid bone 35 or alternatively at a position shifted therefrom in the foot length direction.

As the arch length, the positions of the foot-tip-side ends 15*p* and 15*q* of the outer arches 15*a* and 15*b* are inputted. That is, the position of the head 36*a* or the intermediary position 36*b* of the fifth metatarsal bone 36 is selected and then, when necessary, the dimensions in the foot length direction from the selected position to the foot-tip-side ends 15*p* and 15*q* are inputted. The heel-side end 15*x* of the outer arches 15*a* and 15*b* is determined with reference to the position of the calcaneus bone 34 and hence input of design parameters is unnecessary. Both ends 15*p*, 15*q*; 15*x* of the outer arches 15*a* and 15*b* are located on the reference plane 12*s* (the upper face 12*s* of the base part 12).

(d) Peak Height and Peak Position of Transverse Arch

Figure 18:
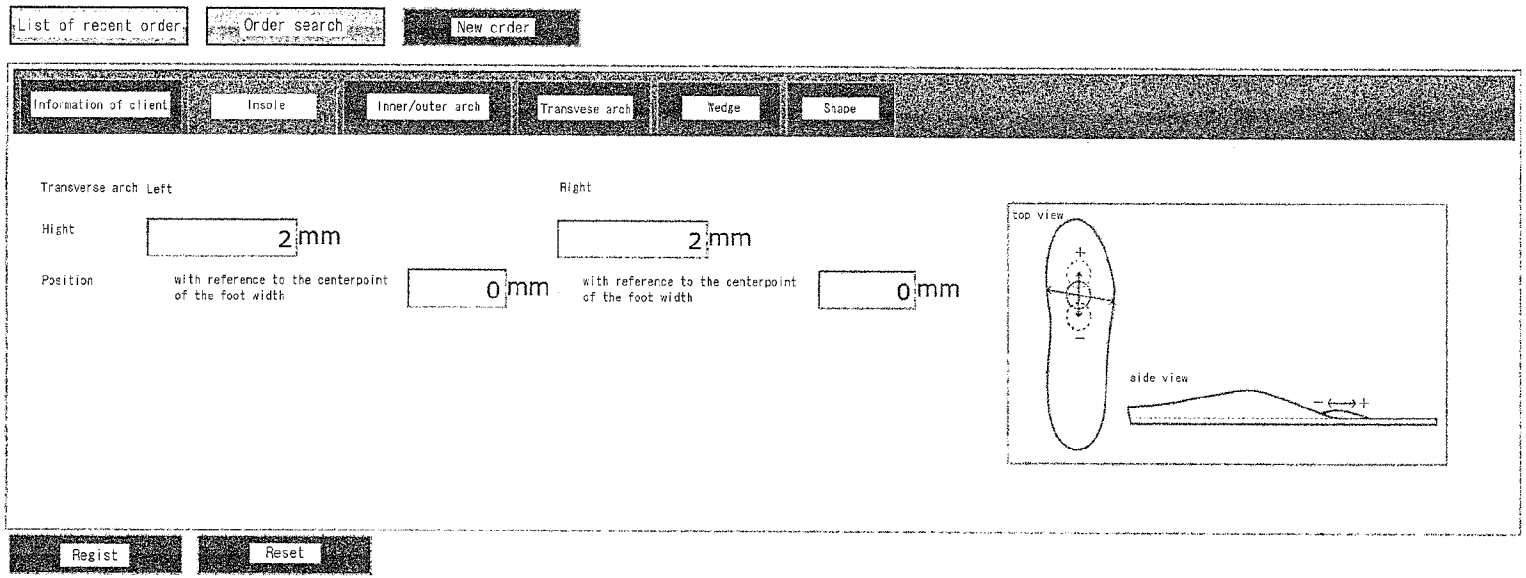
FIG. 18 is an explanation diagram for screen display on a terminal.

In a state that the screen shown in FIG. 18 is displayed on the terminal 70, when the terminal 70 is operated, design parameters (the peak height and the peak position) concerning the transverse arch 10*c* (see FIG. 2) of the insole 10 can be inputted.

Figure 11:
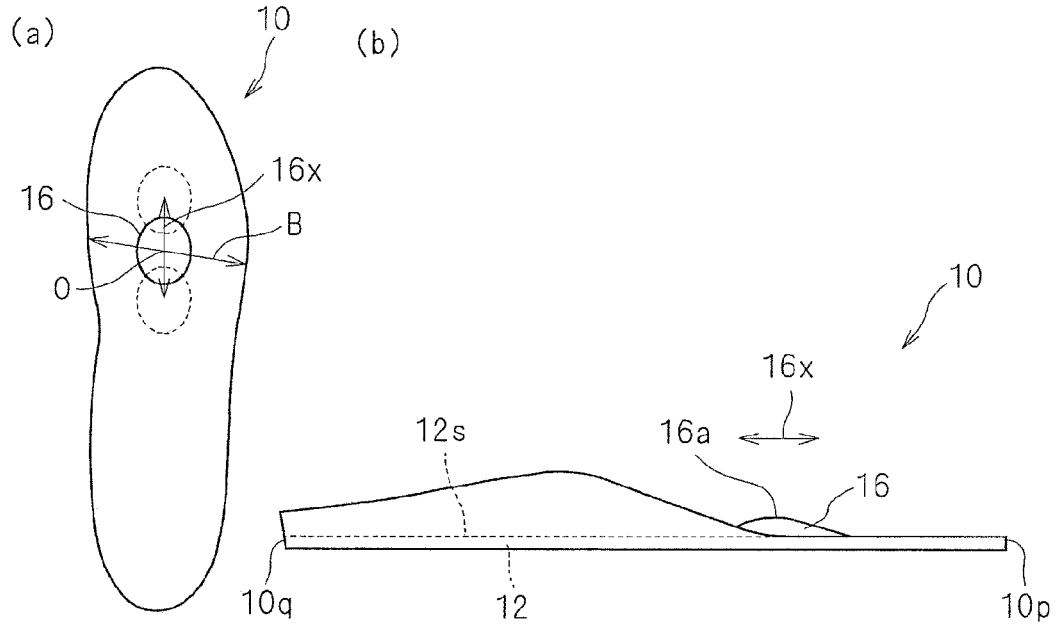
FIG. 11 is an explanation diagram for design parameters of an insole.

As shown in the plan view of FIG. 11(*a*) and the side view of FIG. 11(*b*), the peak height indicates the height of the peak 16*a* of the transverse arch 16 and is a vertical projection dimension from the reference plane 12*s*. The peak position is defined with reference to the center point O of the foot width B and, when necessary, a dimension is inputted by which the peak 16*a* of the transverse arch 16 is to be shifted from the reference position (the center point O) in the foot length direction indicated by an arrow 16*x*.

Here, the peak position of the transverse arch is fixed in the foot width direction. Since the cross-sectional shape of the transverse arch is determined in advance, the peak length is determined from the peak height. However, a configuration may be employed that the peak position in the foot width direction can be inputted (can be moved). Further, a configuration may be employed that the peak length can be inputted.

(e) Wedge

Figure 14:
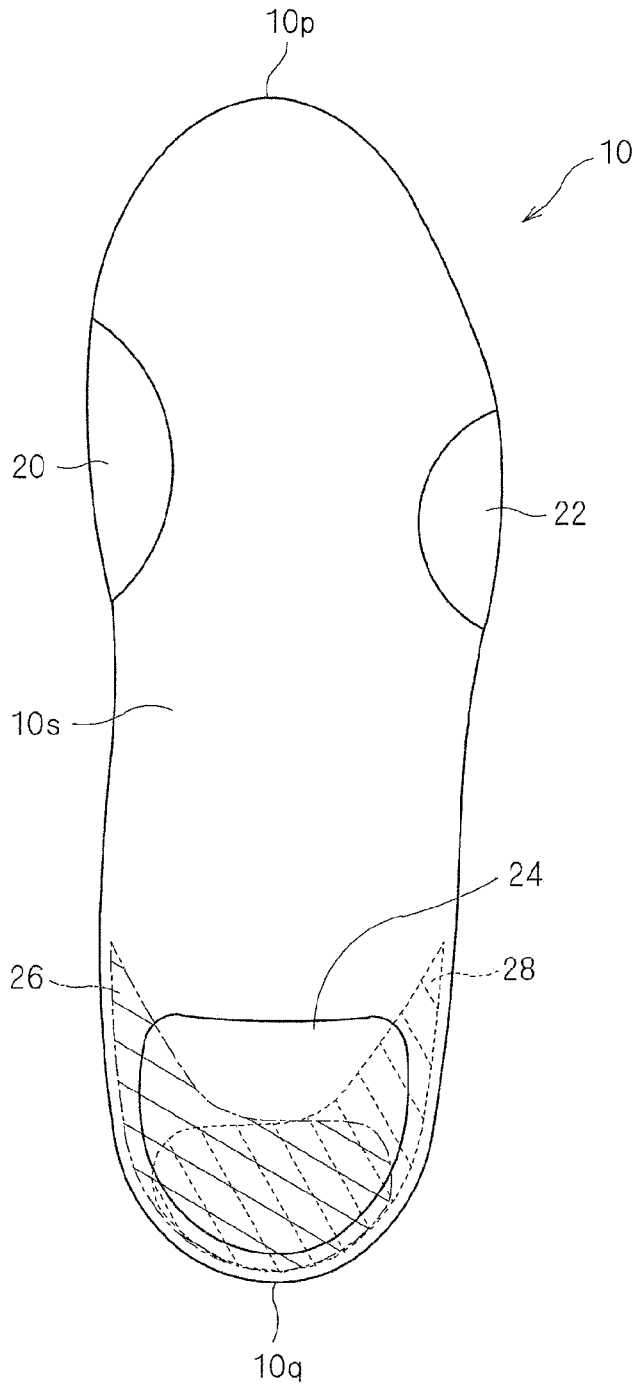
FIG. 14 is an explanation diagram for design parameters of an insole.
Figure 19:
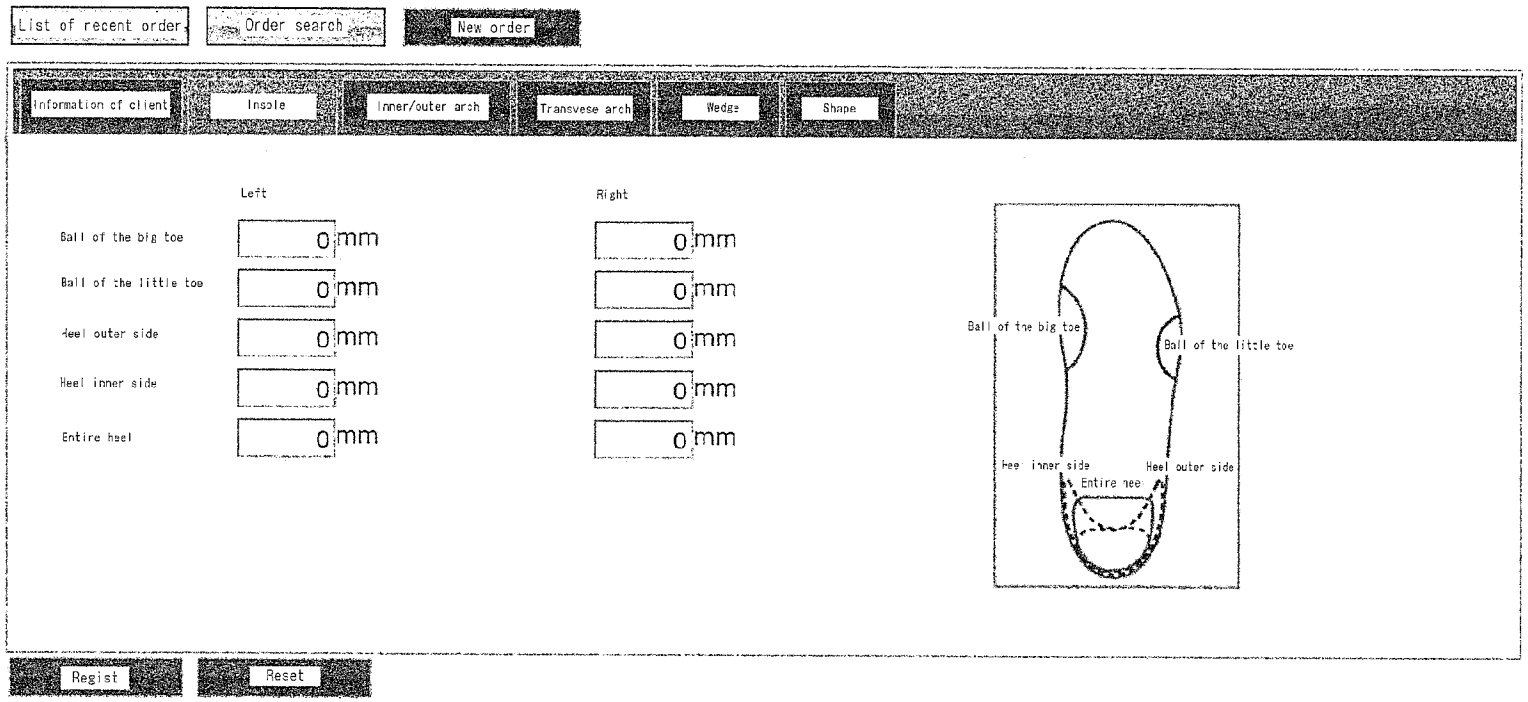
FIG. 19 is an explanation diagram for screen display on a terminal.

In a state that the screen shown in FIG. 19 is displayed on the terminal 70, when the terminal 70 is operated, the heights of the ball 20 of the big toe, the ball 22 of the little toe, the entire heel 24, the heel inner side 26, and the heel outer side 28 from the reference plane 12*s* as shown in the explanation diagram of FIG. 14 are inputted as the design parameters. On the basis of these parameters, the inclination of the foot can be adjusted.

(f) Shape of Heel

Figure 20:
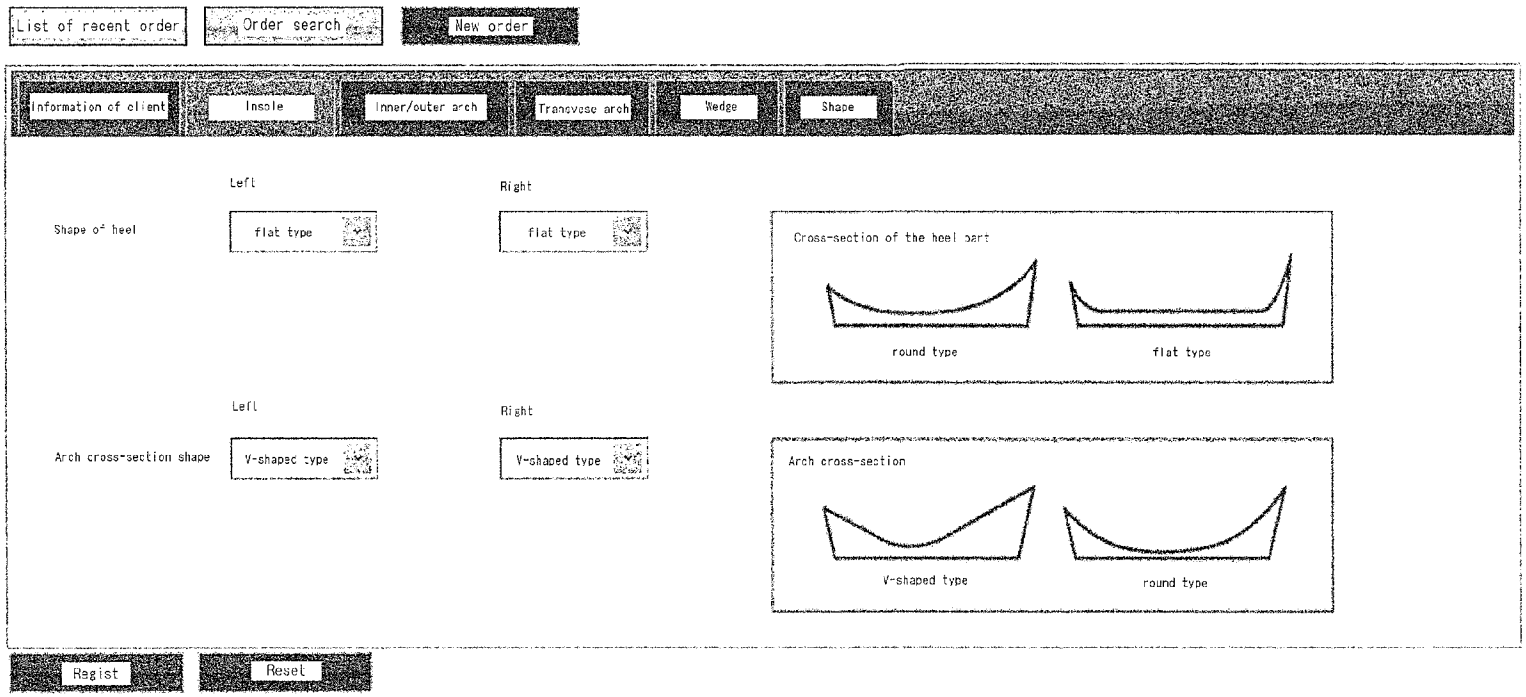
FIG. 20 is an explanation diagram for screen display on a terminal.

In a state that the screen shown in FIG. 20 is displayed on the terminal 70, when the terminal 70 is operated, design parameters concerning the shape of the heel part can be inputted.

Figure 12:
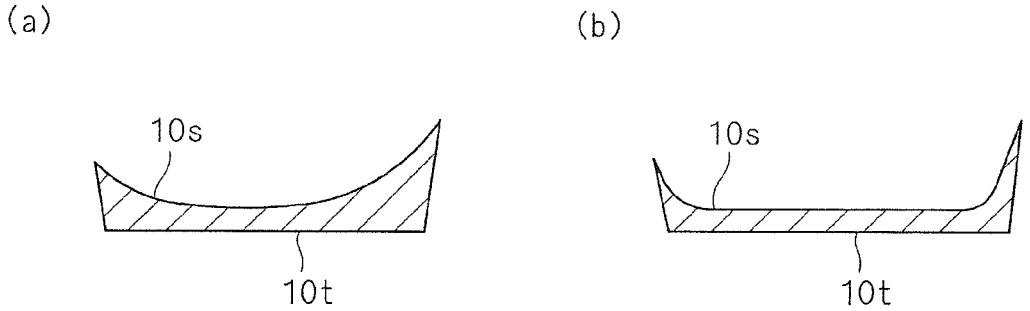
FIG. 12 is an explanation diagram for design parameters of an insole.

The shape of the heel part is selected from the round type shown in FIG. 12 (*a*) and the flat type shown in FIG. 12 (*b*). Each of FIGS. 12 (*a*) and 12 (*b*) shows a cross section of the heel part 10*d* of the insole 10 taken along the foot width direction (a direction intersecting with the foot length direction).

(g) Arch Cross-Sectional Shape

In a state that the screen shown in FIG. 20 is displayed on the terminal 70, when the terminal 70 is operated, design parameters concerning the arch cross-sectional shape can be inputted.

Figure 13:
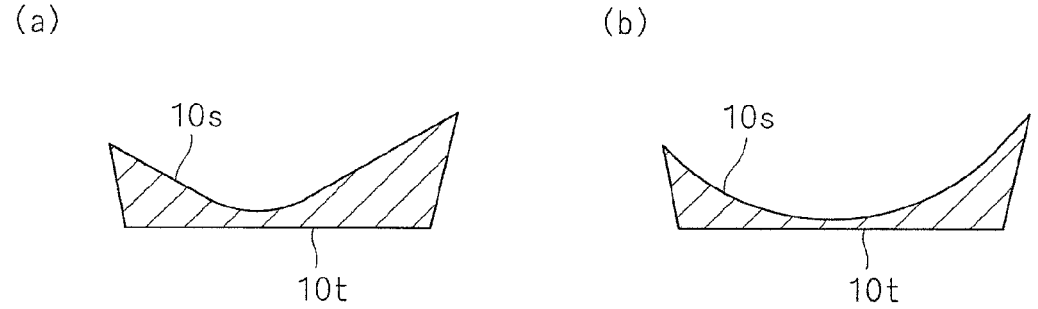
FIG. 13 is an explanation diagram for design parameters of an insole.

The arch cross-sectional shape is selected from the V-shaped type shown in FIG. 13(*a*) and the round type shown in FIG. 13 (*b*). Each of FIGS. 13 (*a*) and 13 (*b*) shows a cross section of the middle part in the foot length direction of the insole 10 taken along the foot width direction.

Returning to FIG. 3, from the position of the bone estimated by the bone position estimation unit 56 and the design parameters whose input has been received by the design parameter input unit 54, the data calculation unit 58 calculates data used for forming the stereoscopic shape of the surface 10*s* of the insole 10. For example, the data calculation unit 58 calculates control data used for controlling the position, the revolving speed, and the like of a cutting tool when a smooth and continuous curved surface shape having the arch shape and the cross-sectional shape defined by the design parameters is to be cut out by an insole machining device. Alternatively, the data calculation unit 58 calculates data serving as the source of control data for the insole machining device, for example, the data of a smooth and continuous curved surface shape having the arch shape and the cross-sectional shape defined by the design parameters. In a case that the insole has a composite structure obtained by joining a plurality of members whose hardness and shapes are different from each other, the data calculated by the data calculation unit 58 may include data of the materials and the dimensions of the members added partly for the purpose of forming the stereoscopic shape of the surface 10*s* of the insole 10.

The output unit 60 outputs the data calculated by the data calculation unit 58 to the insole machining device directly, to a temporary memory, to a recording medium, to a terminal for design, or to any other terminal.

When the insole design system 50 described above is employed, the shape of the insole can be designed easily and efficiently with taking into consideration the position of the bone of the foot. The design parameters are determined with reference to the position of the bone. Thus, when a design rule is set forth in advance, any person can perform the design similarly so that insoles of fixed quality can be designed and fabricated.

Further, since the design parameters are defined with reference to the position of the bone, the design parameters can be explained in an easy-to-understand manner.

Further, as the fabrication history of the insole, design parameters defined with reference to the position of the bone of the foot are accumulated so that the fabrication history of the insole can be utilized easily and efficiently, for example, in a case that an insole used in another shoe is to be fabricated on the basis of design data of an insole fabricated in the past or, alternatively, in a case that an insole is to be refabricated with observing a change in the shape of the foot or in the motion of the foot at the time of walking caused by the use of the insole. For example, when the arch structure of the foot is to be corrected by using an insole, an insole whose shape is changed in accordance with advancement in the correction can be designed and fabricated easily.

<Conclusion>When the insole design system described above is employed, the design parameters can be determined in accordance with a fixed rule and the design parameters can be explained in an easy-to-understand manner.

Here, the present invention is not limited to the above-mentioned embodiments and may be implemented in a state that various kinds of changes are added.

For example, the design parameters and the bone serving as a reference of the design parameters may be selected suitably and the selection is not limited to the embodiments. For example, input of design parameters concerning the positions in the foot width direction of the inner arch and the outer arch may be received.

Further, in addition to application to an insole equipped in footwear in an attachable and detachable manner (an insole fabricated separately from footwear), the insole design system of the present invention may be applied to an insole constituting a part of footwear (a portion in contact with the sole) (an insole belonging to footwear itself). For example, the insole design system of the present invention may have a configuration that the data calculation unit calculates machining device control data used for cutting out the surface shape of an in-contact-with-the-sole portion of footwear such as a sandal and a wooden clog.

DESCRIPTION OF REFERENCE NUMERALS

2 Foot
4 Inner side longitudinal arch
6 Outer side longitudinal arch
8 Transverse arch
10 Insole
10*a* Inner arch
10*b* Outer arch
10*c* Transverse arch
10*d* Heel part
10*p* Foot tip
10*q* Heel-side end
10*s* Surface
12 Base part
12*s* Upper face (reference plane)
12*t* Bottom face
14*a*, 14*b* Inner arch
14*p*, 14*q* Foot-tip-side end (one end)
14*s*, 14*t* Peak
14*x* Heel-side end (other end)
15*a*, 15*b* Outer arch
15*p*, 15*q* Foot-tip-side end (one end)
15*s*, 15*t* Peak
15*x* Heel-side end (other end)
16 Transverse arch
16*a* Peak
16*x* Foot length direction
20 Ball of big toe
22 Ball of little toe
24 Entire heel
26 Heel inner side
28 Heel outer side
30 Skeleton

31 Metatarsal
31*a* Head of bone
31*b* Near side of head of bone
32 Medial cuneiform bone
33 Navicular bone
34 Calcaneus bone
34*x* Sustentaculum tali
35 Cuboid bone
36 Fifth metatarsal
36*a* Head of bone
36*b* Intermediary position
50 Insole design system
52 Foot dimensions input unit
54 Design parameter input unit
56 Bone position estimation unit
58 Data calculation unit
60 Output unit
70 Terminal
80 Communication network

The invention claimed is:

1. An insole design and fabricate system, comprising:

a terminal for inputting a dimension of an outer shape of a foot and a design parameter;

a server connected to the terminal; and an insole machining device for forming a stereoscopic shape of a surface of an insole, wherein the server is configured to:

receive the dimension of the outer shape of the foot and the design parameter from the terminal;

estimate a position of a bone of the foot from the received dimension of the outer shape of the foot by using a standard model, wherein the bone of the foot serves as a reference of a received design parameter, wherein the received design parameter decides a shape of a specific portion of the surface of the insole with reference to the estimated position of the bone of the foot, and wherein in the standard model, a dimension of an outer shape of a foot of the standard model and a position of a bone of the foot of the standard model are in advance made into correspondence to each other;

and calculate data for forming the surface of the insole from the estimated position of the bone of the foot and the received design parameter, wherein the insole machining device is configured to receive the calculated data for forming the surface of the insole from the server, wherein the dimension of the outer shape of the foot includes a foot length, a foot width and a heel width;

the specific portion includes an inner arch corresponding to an inner side longitudinal arch of the foot;

the design parameter includes a peak height, a peak position, and an arch length of the inner arch;

the peak position of the inner arch is determined with reference to any one of a medial cuneiform bone, a navicular bone, and a sustentaculum tali of a calcaneus bone;

in the arch length of the inner arch, one end of the inner arch is determined with reference to a position of a heel and another end of the inner arch is determined with reference to a position of a first metatarsal bone; and the server estimates positions of the medial cuneiform bone, the navicular bone, the calcaneus bone and the sustentaculum tali thereof, and the first metatarsal bone, from the received dimension of the outer shape of the foot, and wherein the specific portion includes an outer arch corresponding to an outer side longitudinal arch of the foot;

the design parameter includes a peak height, a peak position, and an arch length of the outer arch;

the peak position of the outer arch is determined with reference to the position of a cuboid bone;

in the arch length of the outer arch, one end of the outer arch is determined with reference to a position of a calcaneus bone and another end of the outer arch is determined with reference to a position of a fifth metatarsal bone; and the server estimates positions of the cuboid bone, the calcaneus bone, and the fifth metatarsal bone from the received dimension of the outer shape of the foot.

2. The insole design and fabricate system according to claim 1, wherein the server is configured to calculate a ratio between the received dimension of the outer shape of the foot and a dimension of the standard model that corresponds to the received dimension of the outer shape of the foot, expand or reduce the standard model on a basis of the calculated ratio, and adopt position of the bone in an expanded or a reduced standard model as the estimated position of the bone of the foot.

3. The insole design and fabricate system according to claim 1, wherein the server is configured to receive the selection of the bone of the foot that serves as the reference of the design parameter.

4. The insole design and fabricate system according to claim 1, wherein the server is a computer and the outer shape of the foot is measured and inputted into the computer through the terminal.

* * * * *